US006121931A

United States Patent [19]

Levi

[11] Patent Number: 6,121,931

[45] Date of Patent: Sep. 19, 2000

[54] PLANAR DUAL-FREQUENCY ARRAY ANTENNA

[75] Inventor: Shem-Tov Levi, Beit Hanan, Israel

[73] Assignee: Skygate International Technology NV, Curacao, Netherlands

[21] Appl. No.: 09/214,301

[22] PCT Filed: Jul. 4, 1996

[86] PCT No.: PCT/IL96/00037

§ 371 Date: Jun. 11, 1999

§ 102(e) Date: Jun. 11, 1999

[87] PCT Pub. No.: WO98/01921

PCT Pub. Date: Jan. 15, 1998

[51] Int. Cl.[7] ..... H01Q 1/38

[52] U.S. Cl. ..... 343/700 MS; 343/829; 343/846

[58] Field of Search ..... 343/700 MS, 725, 343/829, 845, 846; H01Q 1/38

[56] References Cited

U.S. PATENT DOCUMENTS 5,003,318 3/1991 Berneking et al. ..... 343/700 MS
5,262,791 11/1993 Tsuda et al. ..... 343/700 MS

FOREIGN PATENT DOCUMENTS 0 433 255 A2 6/1991 European Pat. Off. ..... H01Q 5/00

*Primary Examiner*—Don Wong
*Assistant Examiner*—Shih-Chao Chen
*Attorney, Agent, or Firm*—Browdy and Neimark

[57] ABSTRACT

A dual-frequency array antenna having an essentially planar structure with electronic beam steering capability in both a low and high frequency band independently of each other, constructed, in a layered formation, from a top planar array antenna unit operating in the low frequency band and a bottom planar array antenna unit operating in the high frequency band. The top planar array antenna is transparent to frequencies in the high frequency band.

28 Claims, 10 Drawing Sheets

PLANAR DUAL-FREQUENCY ARRAY ANTENNA

FIELD OF THE INVENTION

The present invention relates to planar antenna assemblies for use in radiowave communications in general and in mobile satellite communication systems in particular.

PRIOR ART

The following is a list of references which are believed to be pertinent to the present invention:

Andrasic G. and James J. R. (1987). "Investigation of Superimposed Dichroic Microstrip Antennas," 5th International Conference on Antenna and Propagation, ICAP 87, pp. 485–488, March–April, York, UK.

Andrasic G. and James J. R. (1988). "Microstrip Window Array," Electronic Letters, Vol. 24, No. 2, pp 96–97.

Hiroyuki Inafuku, et al. (1989) "Mobile Receiving Antenna System of Direct Broadcast Systems for Train Applications," International Symposium of Antennas and Propagation, Tokyo, Japan, August.

Lee S. W., et al. (1982). "Simple Formulas for Transmission Through Periodic Metal Grids or Plates," IEEE Transactions and Antennas and Propagation, Vol. AP-30, pp. 904–909.

U.S. Pat. No. 5,043,738

U.S. Pat. No. 5,262,791

The above references will be referred to herein by indicating, within brackets, the name of the author or company and the year of publication, or the patent number, whatever the case may be.

BACKGROUND OF THE INVENTION

A major requirement in achieving a satisfactory communication link between a ground station and a satellite is that the ground station antenna point in the direction of the satellite, i.e. that the maximum of the ground station antenna's beam pattern be aligned along the line of sight between the ground station and the satellite. If the ground station is a mobile platform and/or the satellite orbit is geostationary, high or medium earth orbit then the antenna has to track the satellite in order to continuously point in the direction of the satellite so as to maintain a reasonable quality communication link.

In the following description and claims reference will be made to $K_u$-band and L-band frequency ranges which are generally accepted to be defined as follows:

$K_u$-band: 10.70–12.75 GHz; L-band: 1.49–1.71 GHz.

Various approaches are known for the architecture of antenna assemblies for mobile and non-mobile communication systems. The most common of these is a two-axis mechanical tracking system. The antenna itself may be a microstrip type or another, such as the NEC (see, e.g., Hiroyuki Inafuku, et al. (1989)) or KVH (KVH Industries, Inc., Middletown, R.I. U.S.A.) systems for, respectively, $K_u$-band and L-band transmissions.

By another mechanical approach a single-axis mechanical tracking system is used, a typical example being the Nippon Steel's single-layer slotted-waveguide array system for $K_u$-band transmission (Nippon Steel Corporation, Tokyo, Japan).

By yet another approach a combination of mechanical and electrical tracking is used, such as in the Ball communications system (Ball Telecommunication Products Division, Colorado, U.S.A.).

There are also known non-mechanical antenna assemblies for mobile communication systems. One such non-mechanical antenna described by CAL (CAL, Ottawa, Ontario, Canada) employs phase control on one axis and fixed beams on the other. A two-axis electrically-steered antenna assembly employing conventional phase control schemes has been described by TECOM (TECOM Industries, Inc., Chatsworth, Calif., U.S.A.).

All these known antenna assemblies for mobile communication systems suffer from the common drawback of operating in a single frequency band. Consequently, if one were interested in a mobile communication system operating in two different frequency bands then two of the above-mentioned antennas would have to be used which obviously increases significantly the spatial requirements. If the two-band service is provided through two different satellites, a mechanical pedestal cannot serve the two antennas. Furthermore, the antennas of the first three groups mentioned above suffer from the additional drawback of having mechanical-tracking systems which tend to be cumbersome and slow, limited in their angular coverage, and which are not planar and have to protrude from the surface to which they are applied. Thus, if such an antenna were to be mounted on a mobile platform such as the roof of a land vehicle, it would alter the aerodynamics of such platform.

There are known dual frequency planar antenna arrays in the art (e.g., U.S. Pat. No. 5,043,738 and U.S. Pat. No. 5,262,791). However, none of the known antennas of this type are constructed from two independent planar array antenna units each with its own ground plane and capable of operating independently in two frequency bands, that may be widely space apart (as used in satellite communications) with substantially no interference between the two planar array antenna units.

SUMMARY OF THE INVENTION

It is the object of the present invention to provide a dual-frequency array antenna with electronic beam steering capability in both frequency bands. independently of each other, constructed from two independent antenna units each operating in a separate frequency band, having an essentially planar structure and being suitable for mounting on an outer surface of either a stationary platform or a mobile platform such as a land vehicle, a marine vessel or an aircraft without significantly altering the profile and aerodynamic properties of such surface.

A planar array antenna assembly according to the invention comprises first and second array antenna units, disposed in a layered formation, for receiving and emitting at two different frequency bands, each having at least one dielectric plate. In the receiving mode of operation the antenna assembly receives electromagnetic radiation from an external source whereas in the transmitting mode of operation the antenna assembly transmits electromagnetic radiation to an external receiver. The array antenna unit that is closer to the external source/receiver will be referred to as the top array antenna unit. The other array antenna unit, which in the layered formation of the antenna assembly will be further from the external source/receiver, will be referred to as the bottom array antenna unit. The terms "top" and "bottom" as applied to the array antenna units should not be misconstrued as fixing the actual orientation of the planar array antenna assembly, which in practice may be horizontal, vertical, or any other required orientation. In relation to both the first and second array antenna units the face of a dielectric plate oriented in the direction of an external source of electromagnetic radiation will be referred to as the "front face" and the face oriented in the opposite direction as the "rear face".

The term "patch" used herein signifies an area filled completely or partially with conducting material applied to a face of a dielectric plate, e.g. by printing conducting surfaces on a dielectric layer or by etching techniques (hereinafter referred to as printing on, or etching on the dielectric layer, respectively).

In the following description and claims reference will be made to feeds, feed lines and feed line terminals. The length of the feeds and the location of the feed line terminals have been chosen for convenience of illustration and should not be construed as necessarily indicative of any actual design. In fact, in most fabrication processes the feeds (also known as microstrip lines) will be terminated at, or near, the edge of the dielectric plate (also known as the feed substrate) on which they are disposed. However, the actual geometry of the feed network, formed by the feeds, is not part of the invention and therefore only a small representative length of each feed is shown. Furthermore, such well known issues, in the design of microstrip antennas, as the positioning of the feed point to adjust the input impedance level are not discussed here.

In accordance with the present invention there is provided a planar antenna assembly for receiving and transmitting electromagnetic radiation in two frequency bands, said planar antenna assembly comprising, in a layered formation, first and second planar array antenna units, said first planar array antenna unit operating in a low frequency band and said second planar array antenna unit operating in a high frequency band, said first planar array antenna unit being the top planar array antenna unit and said second planar array antenna unit being the bottom planar array antenna unit;

said first planar array antenna unit comprising at least one dielectric plate having front and rear faces, at least one planar array of patches having a plurality of patches, a feed array having a plurality of feeds and a ground plane;

each feed of said feed array being coupled to a respective one of said patches of said at least one planar array of patches;

each patch of said at least one planar array of patches being resonant to frequencies in said low frequency band and transparent to frequencies in said high frequency band;

said ground plane being reflective to frequencies in said low frequency band and transparent to frequencies in said high frequency band;

said second planar array antenna unit comprising at least one dielectric plate having front and rear faces, a ground plane, at least one planar array of patches having a plurality of patches and a feed array having a plurality of feeds, each feed of said feed array being coupled to a respective one of said patches of said at least one planar array of patches.

The difference between the first planar array antenna unit and the second planar array antenna unit, apart from their operating frequencies, is that the patches and the ground plane of the first planar array antenna unit are frequency selective surfaces being transparent to frequencies in the high frequency band enabling the second planar array antenna unit to transmit and receive electromagnetic radiation band despite the presence of the first planar array antenna unit situated between the second planar array antenna unit and the external body. Furthermore, the ground plane of the first planar array antenna unit is reflective to frequencies in the low frequency band and therefore electromagnetic radiation with frequencies within the low frequency band do not interact with the second planar array antenna unit.

Due to the fact that there are a number of embodiments of the first planar array antenna unit and of the second planar array antenna unit that are common in structure reference will be made in the following to a "planar array antenna unit" that will be used as a generic term for both the first planar array antenna unit and the second planar array antenna unit. Similarly, the terms planar array of patches, patches, feed array, feed and ground plane will be used in the description of the following embodiments as generic terms for both the first and second planar array antenna units.

In accordance with a first aspect of the invention, the planar array antenna unit comprises a first dielectric plate and a first planar array of patches having a plurality of patches, said first planar array of patches and said feed array being disposed on the front face of said first dielectric plate with each feed of said feed array being electrically coupled to a respective one patch of said patches of said first planar array of patches and said ground plane being disposed on said rear face of said first dielectric plate. This defines a first or second planar array antenna unit with electrically (directly) coupled patches.

If desired the planar array antenna unit further comprises a second dielectric plate and a second planar array of patches having a plurality of patches, said second planar array of patches being disposed on the front face of said second dielectric plate, said rear face of said second dielectric plate facing the front face of said first dielectric plate and each patch of said first planar array of patches being substantially aligned with a respective one patch of said patches of said second planar array of patches. This defines a double stack first or second planar array antenna unit with electrically coupled patches.

In accordance with a second aspect of the invention, the planar array antenna unit comprises first and second dielectric plates and a first planar array of patches, said first planar array of patches being disposed on the front face of said first dielectric plate and said feed array being disposed on the rear face of said first dielectric plate with each feed of said feed array being electromagnetically coupled to a respective one patch of said patches of said first planar array of patches, said ground plane being disposed on said rear face of said second dielectric plate, and the front face of said second dielectric plate facing the rear face of said first dielectric face. This defines a first or second planar array antenna unit with electromagnetically coupled patches.

In accordance with a third aspect of the invention, the planar array antenna unit comprises first and second dielectric plates and a first planar array of patches having a plurality of patches, said first planar array of patches being disposed on the front face of said first dielectric plate, said ground plane being disposed on the rear face of said first dielectric plate, said ground plane having a plurality of apertures, the front face of said second dielectric plate facing the rear face of said first dielectric face and said feed array being disposed on the rear face of said second dielectric plate with each feed of said feed array being electromagnetically coupled to a respective one of said patches of said first planar array of patches via a respective one of said apertures in said ground plane, said apertures being resonant to frequencies within the operating frequency band of the planar array antenna unit. Wherein said operating frequency band is said low (high) frequency band if the planar array antenna unit is said first (second) planar array antenna unit. This defines a first or second planar array antenna unit with aperture coupled patches.

If desired the planar array antenna unit according to either the second or the third aspects of the invention further comprises a third dielectric plate and a second planar array of patches having a plurality of patches, said second planar array of patches being disposed on the front face of said third dielectric plate, said rear face of said third dielectric plate facing the front face of said first dielectric plate and each patch of said second planar array of patches being substantially aligned with a respective one of said patches of said first planar array of patches. This defines a double stack first or second planar array antenna unit with, in accordance with the second aspect of the invention, electromagnetically coupled patches or, in accordance with the third aspect of the invention, aperture coupled patches.

In accordance with a fourth aspect of the invention, the first planar array antenna unit comprises first and second dielectric plates and a first planar array of patches having a plurality of patches, said planar array of patches being disposed on the front face of said first dielectric plate, said ground plane being disposed on the rear face of said first dielectric plate, said first dielectric plate being spaced from said second dielectric plate so as to form an antenna chamber, said feed array being disposed on the rear face of said second dielectric plate with each feed of said feed array being electrically coupled to a respective one of said patches of said first planar array of patches by a plurality of feed probes and said second planar array antenna unit being located within said antenna chamber. This defines a first planar array antenna unit with probe fed patches.

If desired the first planar array antenna unit according to the fourth aspect of the invention further comprises a third dielectric plate and a second planar array of patches having a plurality of patches, said second planar array of patches being disposed on the front face of said third dielectric plate, said rear face of said third dielectric plate facing the front face of said first dielectric plate and each patch of said second planar array of patches being substantially aligned with a respective one of said patches of said first planar array of patches. This defines a double stack probe planar array antenna unit with probe fed patches.

In accordance with the present invention the planar antenna assembly can be constructed from all the combinations of the first planar array antenna unit embodiments defined above taken together with all the combinations of the second planar array antenna unit embodiments defined. That is, the planar antenna assembly can be constructed from:

(1a) a first planar array antenna unit with electrically coupled patches any of:
- (2a) a double stack first planar array antenna unit with electrically coupled patches,
- (3a) a first planar array antenna unit with electromagnetically coupled patches,
- (4a) a double stack first planar array antenna unit with electromagnetically coupled patches,
- (5a) a first planar array antenna unit with aperture coupled patches,
- (6a) a double stack first planar array antenna unit with aperture coupled patches,
- (7a) a first planar array antenna unit with probe fed patches, or
- (8a) a double stack first planar array antenna unit with probe fed patches;

taken together with any of:
- (1b) a second planar array antenna unit with electrically coupled patches,
- (2b) a double stack second planar array antenna unit with electrically coupled patches,
- (3b) a second planar array antenna unit with electromagnetically coupled patches,
- (4b) a double stack second planar array antenna unit with electromagnetically coupled patches,
- (5b) a second planar array antenna unit with aperture coupled patches,
- (6b) a double stack second planar array antenna unit with aperture coupled patches;

The first and second planar array antenna units can be designed for the reception and transmission of linearly or circularly polarized electromagnetic radiation.

When the first planar array antenna unit is designed for the reception and transmission of circularly polarized electromagnetic radiation it is characterized in that:

said at least one array of patches of said first planar array antenna unit is grouped into 2×2 patch subarrays having each in clockwise or counter-clockwise sequence first, second, third and fourth subarray members; said feeds of said feed array of said first planar array antenna unit are grouped into 2×2 feed subarrays having each in clockwise or counter-clockwise sequence first, second, third and fourth subarray members; each member of a given feed subarray being coordinated with one member of a given patch subarray, the feeds and patches in a given coordinated subarray being rotated by 90° with respect to a sequentially preceding subarray member. Each of the members of the first feed array is linked to a suitable electronics system as known per se containing a phase control device. By suitably adjusting the phase control device the currents flowing in the individual members of each 2×2 feed subarray can be phase-delayed by 0°, 90°, 180° and 270° in a clockwise (or optionally counter-clockwise for replacing right hand by left hand circular polarization) sequence.

When the second planar array antenna unit is designed for the reception and transmission of circularly polarized electromagnetic radiation it is characterized in that:

said at least one array of patches of said second planar array antenna unit is grouped into 2×2 patch subarrays having each in clockwise or counter-clockwise sequence first, second, third and fourth subarray members; said feeds of said feed array of said second planar array antenna unit are grouped into 2×2 feed subarrays having each in clockwise or counter-clockwise sequence first, second, third and fourth subarray members; each member of a given feed subarray being coordinated with one member of a given patch subarray, the feeds and patches in a given coordinated subarray being rotated by 90° with respect to a sequentially preceding subarray member. Each of the members of the second feed array is linked to a suitable electronics system as known per se containing a phase control device. By suitably adjusting the phase control device the currents flowing in the individual members of each 2×2 feed subarray can be phase delayed by 0°, 90°, 180° and 270° in a clockwise (or optionally counter-clockwise for replacing right hand by left hand circular polarization) sequence.

Clearly, the first planar array antenna unit and the second planar array antenna unit can be designed to operate either both in the circular polarization mode, or one in the circular polarization mode and the other in the linear polarization mode.

The patches of the first planar array antenna unit may be of any suitable shape such as circular, polygonal or square, and the like.

In accordance with the present invention, said patches of said first planar array antenna unit are frequency selective surfaces comprising a periodic arrangement of apertures in each patch. Optionally, said patches are frequency selective surfaces comprising a grid of conducting lines with a uniform mesh.

Further in accordance with the present invention said ground plane of said first planar array antenna unit is a frequency selective surface comprising a periodic arrangement of apertures in the ground plane. Optionally, said ground plane is a frequency selective surface comprising a grid of conducting lines with a uniform mesh.

The patches of the second planar array antenna unit may be of any suitable shape such as circular, polygonal or square, and the like. There is no necessity that the shape of the patches of the second planar array antenna unit match those of the first planar array antenna unit.

If desired, said ground plane of the first planar array antenna unit can be designed as a frequency selective surface by forming in it apertures that match in shape the patches of the second planar array antenna unit. In accordance with this embodiment each one aperture in the ground plane is located opposite one patch of the second planar array antenna unit.

A planar antenna assembly according to the invention and each of its planar array antenna units is designed for operation in both transmitting and receiving modes. During the transmitting mode, the electronics system associated with a transmitting antenna unit feeds each of the members of the feed array thereof with time-varying electric power whereby the antenna unit is excited for radiating a beam into the surrounding atmosphere. During the receiving mode external electromagnetic radiation incident on the planar array antenna units from the surrounding atmosphere excites the patches whereby an output signal is produced at the feeds. Each feed is equipped with a feed line terminal to which feed lines can be connected for linking the feeds to suitable electronics systems containing phase control devices.

It should be noted that, the first and second antenna units operate completely independent of each other. Consequently, either of them may be transmitting or receiving while the other one is at rest. Likewise, while the first antenna unit transmits the second one may be receiving, and vice versa.

In one embodiment of the invention said low frequency band at which the first antenna unit operates is the L-band and said high frequency band at which the second antenna unit operates is the $K_u$-band.

Preferably a planar antenna assembly according to the invention is mounted within a suitable casing of weather resistant material. Said casing protects the sides of the planar antenna assembly but does not cover its front face.

Preferably, a radome transparent to electromagnetic radiation with frequencies within both said first and second frequency bands, is mounted on the first planar antenna unit so as to cover the front face thereof. The radome serves to protect the entire planar antenna assembly from adverse climatic and other external influences such as rain, ice, heat, sunlight, sandstorms, salt water, etc.

Quite generally, the dielectric plates of the planar antenna assembly can be constructed from a plurality of dielectric plates of differing electric properties. However, it should be noted that a dielectric plate which does bear on either of its faces any structure (i.e., patches, feeds or a ground plane) and serves merely to separate between different layers in the planar antenna assembly of the invention can be replaced by an air gap, provided some form of support is applied to the edges of the separated layers in order to maintain their separation.

BRIEF DESCRIPTION OF THE DRAWINGS

For a better understanding, the invention will now be described, by way of example only, with reference to the accompanying drawings in which.

DESCRIPTION OF SPECIFIC EMBODIMENTS

Figure 1:
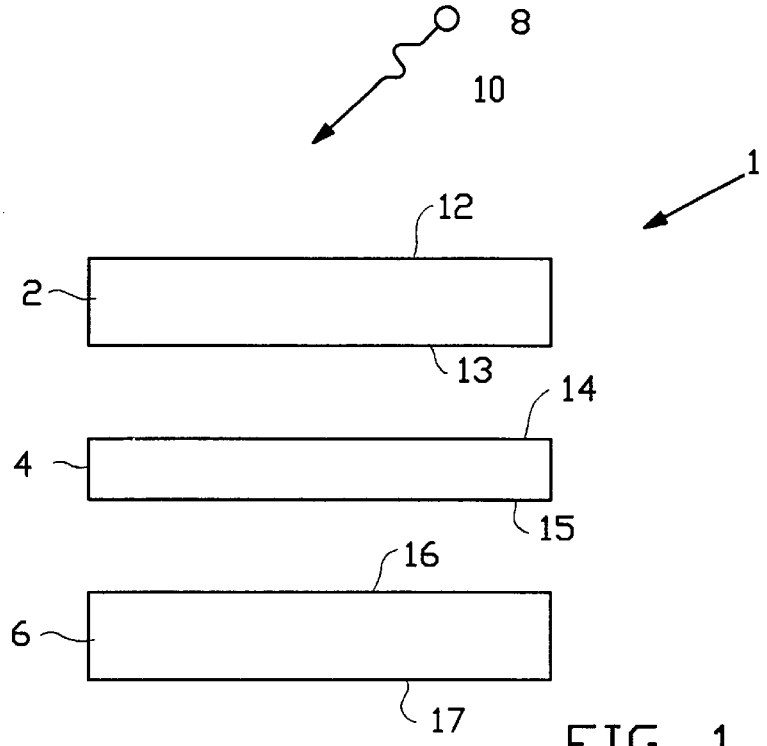
FIG. 1 shows a schematic exploded side view of the planar antenna assembly of the invention and an external source of electromagnetic radiation.

Attention is first drawn to FIG. 1 showing a schematic exploded side view of the planar antenna assembly 1 of the invention, which comprises three parts, a first planar array antenna unit 2, a dielectric plate 4 and a second planar array antenna unit 6. Also shown is an external source 8 of electromagnetic radiation 10. The "front face" and the "rear face" of any part of the planar antenna assembly, and of the planar antenna assembly itself, are defined relative to the external source 8. Hence, the front face 12 of the first planar array antenna unit 2 is that face orientated in the direction of the external source 8, whereas its rear face 13 is orientated in the opposite direction. Clearly then, electromagnetic radiation 10 incident on the first planar array antenna unit 2 from the external source 8 will be incident on the front face 12 and after passing through the first planar array antenna unit 2 it will exit from its rear face 13. Similarly, the dielectric plate has a front face 14 and a rear face 15 and the second planar array antenna unit 6 has a front face 16 and a rear face 17. In accordance with this terminology the planar antenna assembly 1 has a front face 12 and a rear face 17.

The first planar array antenna unit 2 is designed to operate in a low frequency band and the second planar array antenna unit 6 is designed to operate in a high frequency band. The two planar array antenna units 2 and 6 are arranged in a layered formation with the first planar array antenna unit 2 being between the second planar array antenna unit 6 and the external source 8. The dielectric plate 4 which serves to separate between the first and second planar array antenna units can be replaced by an air gap provided some form of support is applied to keep the construction of the planar antenna assembly 1 intact. Although the first planar array antenna unit 2 is positioned between the second planar antenna unit 6 and the external source 8 the second planar array antenna unit 6 is not prevented from receiving electromagnetic radiation with frequencies in the high frequency band since the first planar array antenna unit 2 is designed to be transparent to frequencies in the high frequency band.

Although the basic construction and operation of the dual frequency planar antenna assembly of the invention has been illustrated for the antenna operating in a receiving mode, the illustration could have equally been made for the antenna operating in a transmitting mode with the external source 8 replaced by an external receiver.

Various embodiments for the two planar array antenna units 2 and 6 will now be described and the construction of the planar antenna assembly of the invention from them will be illustrated. In the Figures illustrating these embodiments dielectric plates, ground planes, patches, feeds and apertures are all shown with exaggerated dimensions for illustrative purposes only. The patches and feeds are shown with different heights in order to differentiate between them, however in practice they are actually printed or etched on the dielectric plates and are of the same height.

Figure 2:
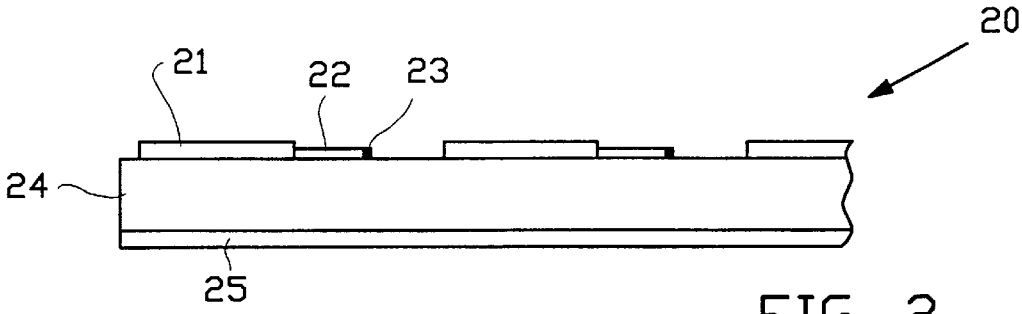
FIG. 2 shows a side elevation view of part of a first embodiment of a first planar array antenna unit.

Attention is first drawn to FIG. 2 showing a side elevation view of part of a first planar array antenna unit 20 in accordance with a first embodiment. The patches 21 and the feeds 22, which are electrically (or directly) coupled to each other, are disposed on the front face of the dielectric plate 24. Each patch is designed to be resonant to frequencies in the low frequency band and transparent to frequencies in the high frequency band. Each feed 22 is equipped with a feed line terminal 23 to which feed lines can be connected for linking the feeds to suitable electronics systems containing phase control devices. The ground plane 25 is disposed on the rear face of the dielectric plate 24 and is designed to be frequency selective, reflecting frequencies in the low frequency band and transmitting frequencies in the high frequency band.

Figure 3:
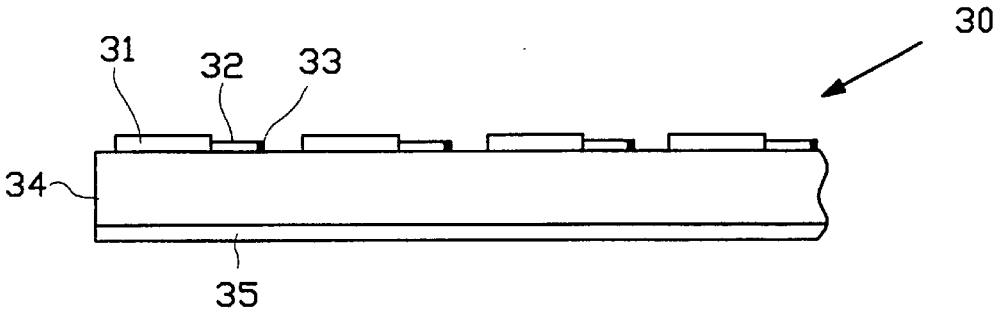
FIG. 3 shows a side elevation view of a part of a first embodiment of a second planar array antenna unit.

FIG. 3 shows a side elevation view of a part of a second planar array antenna unit 30, in accordance with a first embodiment. The patches 31 and the feeds 32, which are electrically coupled to each other, are disposed on the front face of the dielectric plate 34. The patches 31 are designed to be resonant to frequencies in the second frequency band. Each feed 32 is equipped with a feed line terminal 33 to which feed lines can be connected for linking the feeds to suitable electronics systems containing phase control devices. The ground plane 35 is disposed on the rear face of the dielectric plate 34. Although the planar array antenna units 20 and 30 are similar in structure there are a number of basic differences between them. First and foremost, the patches 31 and the ground plane 35 are simply conducting surfaces, as compared to the patches 21 and ground plane 25 which are frequency selective. Furthermore, the dimensions of the patches 21 and 31 will in general be different. Since the patches 21 operate in a low frequency band and the patches 31 in a high frequency band, then the patches 31 will be smaller than the patches 21. Hence, for a given planar array antenna unit gain, there will be more patches 31 than patches 21. Furthermore, the height and properties of the dielectric plate 24 are not necessarily the same as those of the dielectric plate 34.

Figure 4:
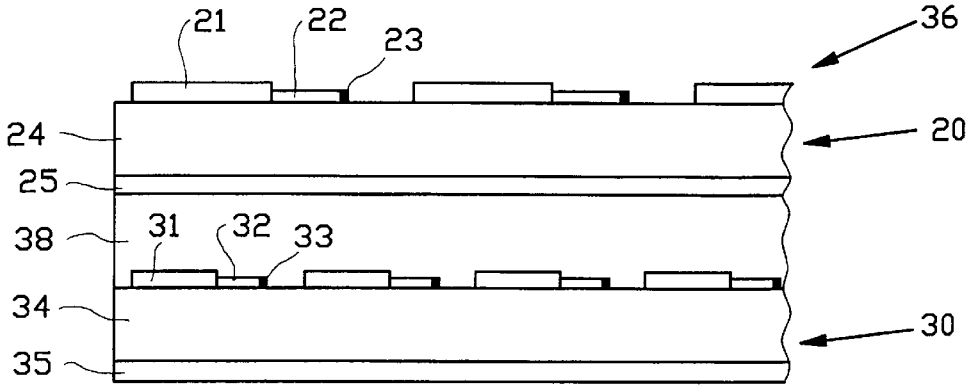
FIG. 4 shows a side elevation view of a part of a first embodiment of a planar antenna assembly of the invention.

FIG. 4 shows a side elevation view of a part of the planar antenna assembly of the invention in accordance with a first embodiment. This embodiment comprises a first planar array antenna unit in accordance with FIG. 2 and a second planar array antenna unit in accordance with FIG. 3. A dielectric plate 38 separates between the two planar array antenna units.

Figure 5:
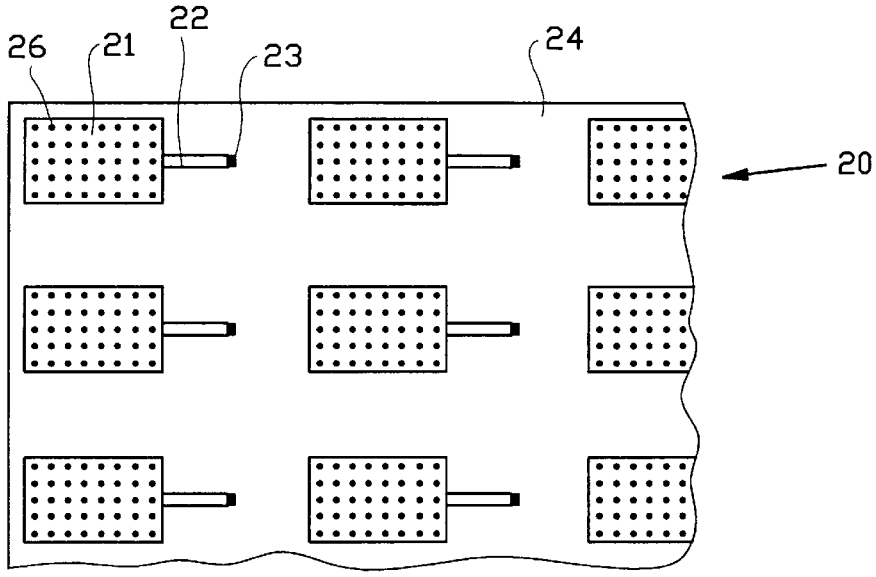
FIG. 5 shows a plan view of the planar array antenna unit illustrated in FIG. 2.
Figure 6:
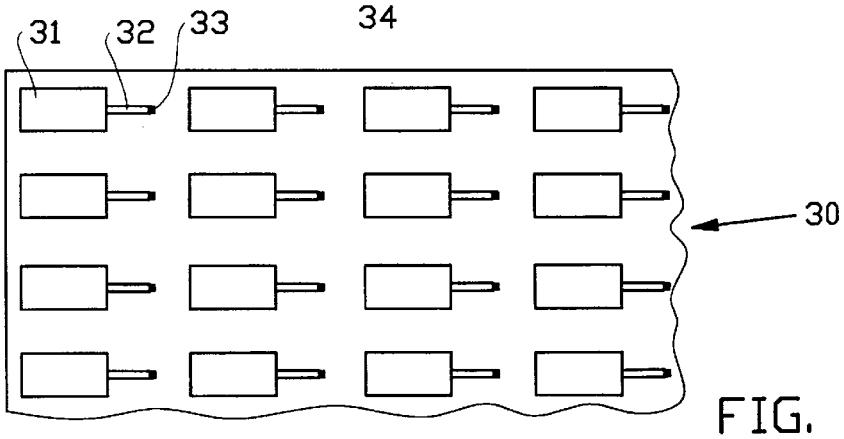
FIG. 6 shows a plan view of the planar array antenna unit illustrated in FIG. 3.

Attention is now drawn to FIGS. 5 and 6 showing plan views of the planar array antenna units 20 and 30, respectively. The patches 21 are frequency selective surfaces, designed to be transparent to frequencies in the high frequency band by any of the known techniques per se. In the particular illustration shown in FIG. 5 the patches 21 are conducting surfaces with a periodic arrangement of apertures 26 in each patch. The dimensions of the patches 21 are chosen such that they are resonant to frequencies in the low frequency band. Also shown are the feeds 22 along with their feed line terminals 23. As shown the feeds 22 are electrically (or directly) coupled to the patches 21. The patches 31 of the second planar array antenna unit 30 are perfect conductors, with their dimensions chosen such that they are resonant to frequencies in the high frequency band. Also shown are the feeds 32 along with their feed line terminals 33. Again the feeds 32 are electrically coupled to the patches 31.

Figure 7:
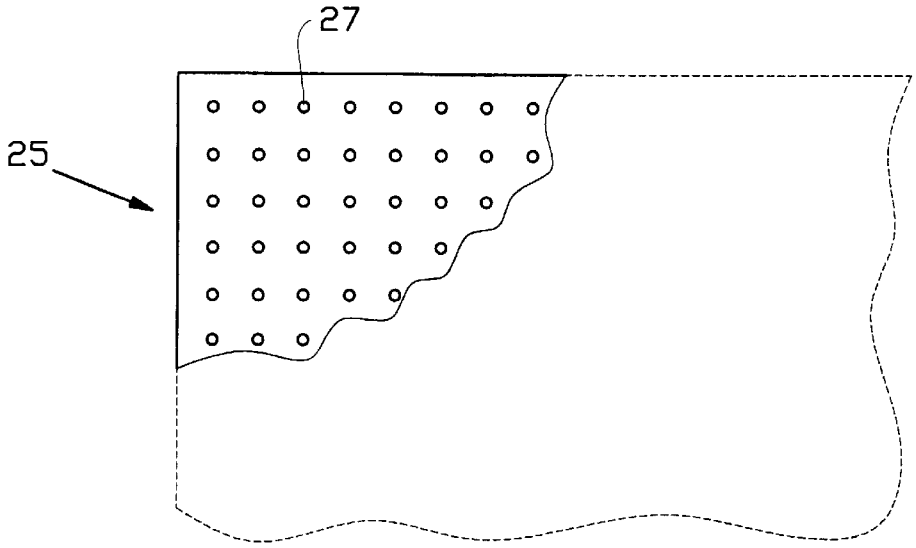
FIG. 7 shows a plan view of one embodiment of a frequency selective ground plane of a first planar array antenna unit.

FIG. 7 shows a plan view of the frequency selective ground plane 25 in accordance with one embodiment. The apertures 27 in the ground plane 25 are periodically arranged and are designed such that the ground plane 25 is reflective to frequencies in the low frequency band and transparent to frequencies in the high frequency band. The patches 21 and the ground plane 25 are illustrated in FIGS. 5 and 7 as having identical apertures 26 and 27, respectively, with identical spacings between the apertures. However, it is pointed out that this need not be the case, and although circular apertures can be used they are to be understood as representative of any appropriate shaped aperture. Typical examples of acceptable shapes for apertures, as known in the art, are: a rectangular slot, a cross, a Jerusalem cross, a disk and an annular ring.

Figure 8:
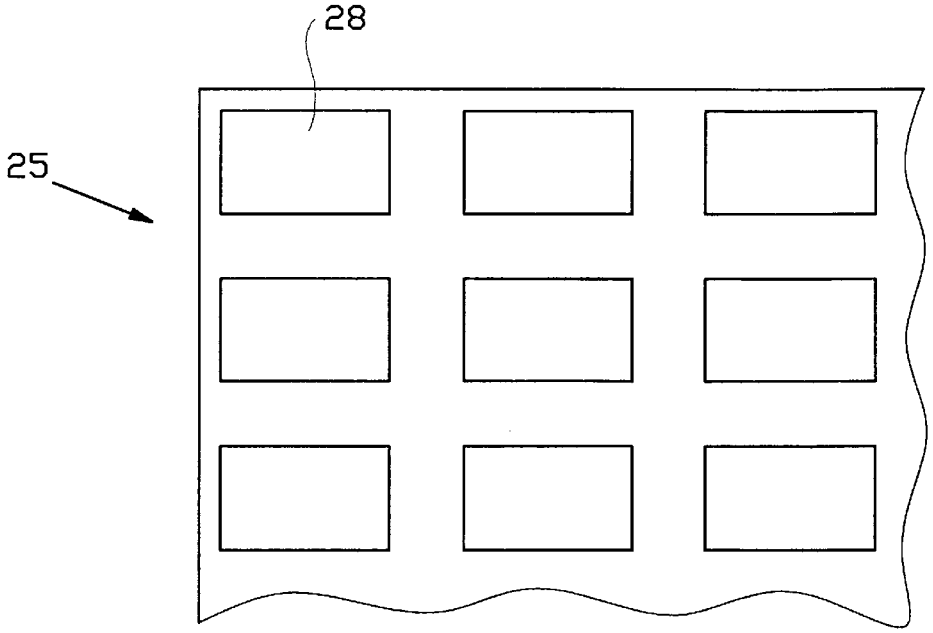
FIG. 8 shows a plan view of another embodiment of a frequency selective ground plane of a first planar array antenna unit.

The actual dimensions of the patches in FIGS. 5 and 6 will depend on the choice of the frequency bands required for a given application and therefore the patches 21 may, in some applications be very much larger than the patches 31. In such applications, the frequency selective ground plane 25 can take on another form as shown in FIG. 8. In accordance with this embodiment the apertures 28 in the ground plane 25 can be, but are not necessarily, the same shape as the patches 31 and each aperture 28 is substantially in alignment with a single patch 31.

Figure 9:
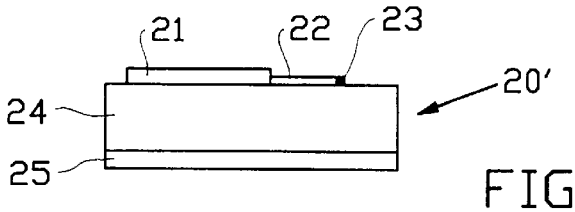
FIG. 9 shows a side elevation view of an antenna unit of a first planar array antenna unit with electrically (or directly) coupled patches.
Figure 10:
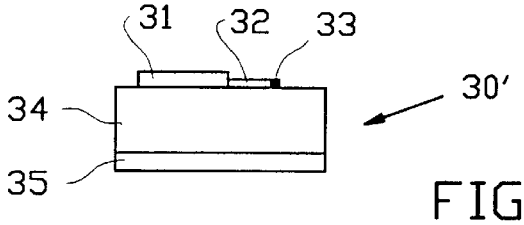
FIG. 10 shows a side elevation view of an antenna unit of a second planar array antenna unit with electrically (or directly) coupled patches.

A number of other embodiments of the antenna assembly of the invention will now be described for various embodiments of the planar array antenna units. To this end it is noted that the first planar array antenna unit 20, shown in FIG. 2, can be specified by the "first antenna unit" 20' shown in FIG. 9, comprising a patch 21, feed 22 with terminal 23, dielectric plate 24 and ground plane 25. This antenna unit is referred to as antenna unit with an electrically (or directly) coupled patch. The first planar array antenna unit 20, as shown in FIGS. 2 and 5, is constructed from the first antenna unit 20' by forming a planar periodic arrangement of first antenna units 20'. In a similar manner, the second planar array antenna unit 30, shown in FIG. 3, can be specified by the "second antenna unit" 30' shown in FIG. 10. Therefore, instead of describing different embodiments for planar array antenna units, different embodiments for antenna units will be described, it being understood that these antenna units are basic building blocks from which the corresponding planar array antenna units can be constructed. Furthermore, by comparing FIGS. 9 and 10 it is evident that one of the Figures would suffice to describe both antenna units, wherein the patch and the ground plane would be frequency selective for the first antenna unit and perfectly conducting in the case of the second antenna unit. Bearing this in mind, only one generic antenna unit will be illustrated in the following description.

Figure 11:
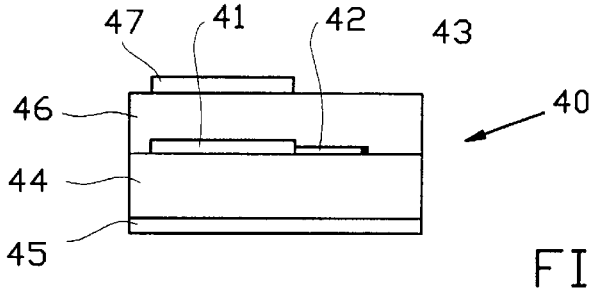
FIG. 11 shows a side elevation view of an antenna unit with a double stack electrically coupled patch.

Attention is now drawn to FIG. 11 showing a double stack antenna unit with an electrically coupled patch 40 which is constructed from an electrically coupled antenna unit comprising a patch 41, feed 42 and feed line terminal 43, disposed on the front face of a dielectric plate 44 and a ground plane 45 disposed on its rear face and a further dielectric plate 46 adjacent to the front face of the dielectric plate 44. The dielectric plate 46 bears on its front face a patch 47 substantially aligned with the patch 41. Clearly the two patches 41 and 47 are electromagnetically coupled. The presence of patch 47 serves to increase the bandwidth of the electrically coupled antenna unit. It should be noted that a completely equivalent structure can be formed by depositing the patch 41, feed 42 and feed line terminal 43 on the rear face of the dielectric plate 46 instead of on the front face of dielectric plate 44. This comment should be taken as a general comment for all embodiments in which a patch or feed is said to be disposed on the front or rear face of two adjacent dielectric plates. That is, the patch or feed could just as well be disposed on the adjacent face of the other dielectric plate.

Figure 12:
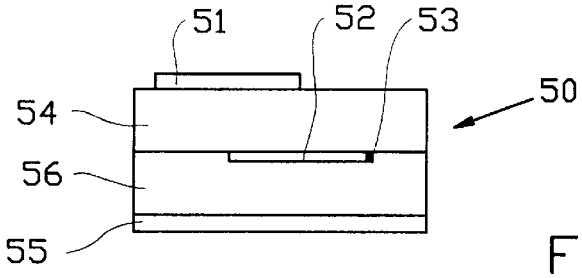
FIG. 12 shows a side elevation view of an antenna unit with an electromagnetically coupled patch.
Figure 13:
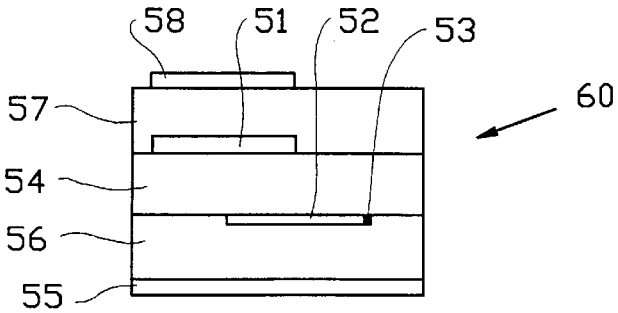
FIG. 13 shows a side elevation view of an antenna unit with a double stack electromagnetically coupled patch.

FIG. 12 shows an antenna unit in which the patch 51 and the feed 52 are electromagnetically coupled. The patch 51 and feed 52 along with its feed line terminal 53 are disposed on opposite sides of the dielectric plate 54. The front face of a second dielectric plate 56 is adjacent to the rear face of the dielectric plate 54, and a ground plane 55 is disposed on the rear face of the dielectric plate 56. A double stack electromagnetically coupled antenna unit 60 is shown in FIG. 13, and is obtained from the antenna unit with an electromagnetically coupled patch 50 by depositing a dielectric plate 57, bearing a patch 58 on its front face, on the front face of the dielectric plate 54. The patches 51 and 58 are substantially aligned with each other.

Figure 14:
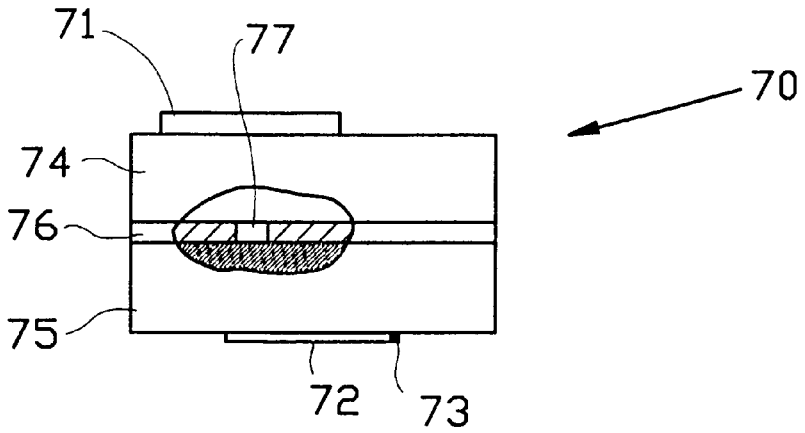
FIG. 14 shows a side elevation view of an antenna unit with an aperture coupled patch, part of the antenna unit being cut away to show an aperture in the ground plane.
Figure 15:
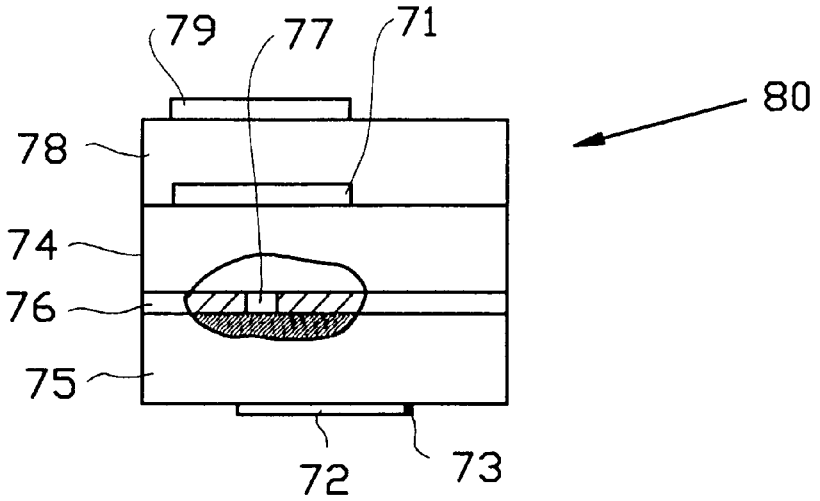
FIG. 15 shows a side elevation view of an antenna unit with a double stack aperture coupled patch, part of the antenna unit being cut away to show an aperture in the ground plane.

FIG. 14 shows an antenna unit 70 with an aperture-coupled patch. The antenna unit comprises a patch 71, a feed 72 with feed line terminal 73, two dielectric plates 74, 75 and a ground plane 76 having an aperture 77. The patch 71 and ground plane 76 are disposed on opposite sides of the dielectric plate 74 and the feed 72 is disposed on the rear face of the dielectric plate 75. The patch 71 and feed 72 are electromagnetically coupled via the aperture 77 in the ground plane 76. A double stack antenna unit aperture-coupled patch 80 is shown in FIG. 15, and is obtained from the antenna unit with an aperture-coupled patch 70 by depositing a dielectric plate 78, bearing a patch 79 on its front face, on the front face of the dielectric plate 74. The patches 71 and 79 are substantially aligned with each other.

As described above, planar array antenna units can be constructed from the above illustrated antenna units by forming a planar periodic arrangement of the antenna units. From the so constructed planar array antenna units planar antenna assemblies can be constructed using the modular approach illustrated in FIG. 1. The first planar antenna unit 2 can be constructed from any of the antenna units 20', 40, 50, 60, 70 and 80 (where the patches and ground planes are frequency selective surfaces as described above) and similarly the second planar antenna unit 6 can be constructed from any of the antenna units 30', 40, 50, 60, 70 and 80 (where the patches and ground planes are perfect conductors).

Figure 16:
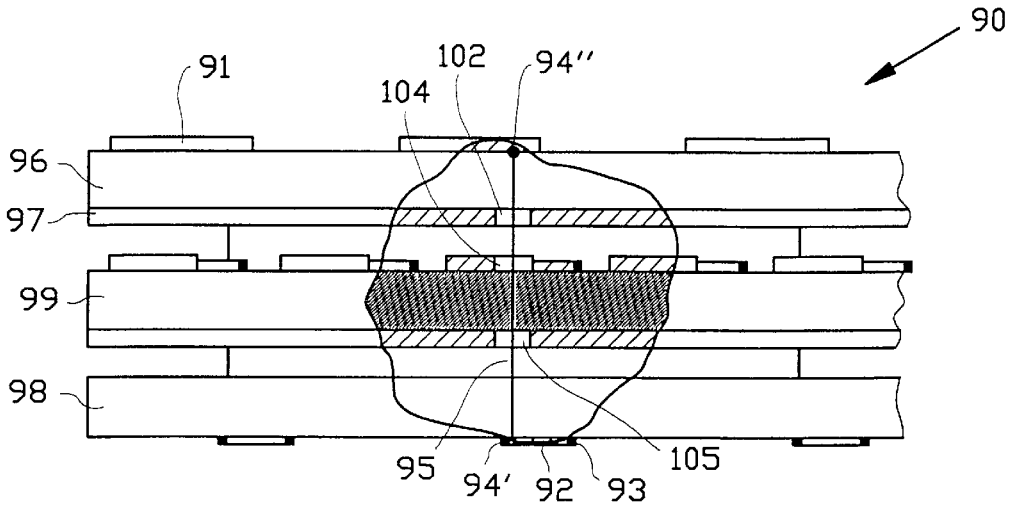
FIG. 16 shows a schematic exploded side elevation view of part of a planar antenna assembly of the invention with a first planar array antenna unit having probe fed patches, part of the assembly being cut away to show a feed patch terminal and holes for contactless passage of feed probes.

In all the planar antenna assemblies described above either the feeds are in the same plane as the patches and electrically coupled to them or they are in a different plane and electromagnetically coupled to them. FIG. 16 shows a schematic exploded side view of part of a planar antenna assembly 90 in which the patches 91 of the first planar array antenna unit are in a different plane from that of their feeds 92. The feeds 92 are equipped with two terminals, feed line terminals 93 to which feed lines can be connected for linking the feeds to suitable electronics systems containing phase control devices and feed probe terminals 94' to which feed probes 95 are connected. Electrical connection between the feeds 92 and the patches 91 is made via the feed probes 95, connected at one end to the feed probe terminals 94' and at the other end to the patch probe terminals 94". Each patch 91 is equipped with one patch probe terminal 94". The patches 91 of the first planar array antenna unit are disposed on the front face of the dielectric plate 96 and the ground plane 97 of the first planar array antenna unit is disposed on the rear face of the dielectric plate 96. The feeds 92 of the first planar array antenna unit are disposed on the rear face of dielectric plate 98. Dielectric plates 96 and 98 of the first planar array antenna unit form an antenna chamber with the second planar array antenna unit 99 located within the antenna chamber. The ground plane 97 of the first planar array antenna unit is fitted with holes 102 for the contactless passage of the feed probes 95. For the sake of illustration the second planar array antenna unit 99 has been chosen to be the second planar array antenna unit shown in FIG. 3, however, can just as well be any of the planar array antenna units that can be formed from the antenna units 40, 50, 60, 70 and 80. The holes 104 and 105 in the patches and ground plane, respectively, of the second planar array antenna unit 99, are for the contactless passage of the feed probes through them.

Figure 17:
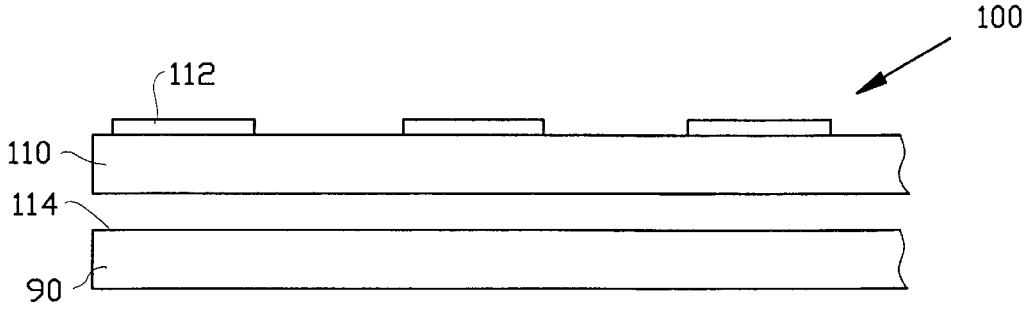
FIG. 17 shows a schematic exploded side elevation view of part of a planar antenna assembly of the invention with a double stack first planar array antenna unit having probe fed patches.

The embodiment of the antenna assembly of the invention, with a first planar array antenna unit having probe fed patches, as shown in FIG. 16, can be extended to an antenna assembly with a double stack probe feed first planar antenna unit, by depositing on the front face of the planar antenna assembly 90 a dielectric plate bearing patches on its front face. FIG. 17 shows a schematic exploded side view of part of a planar antenna assembly 100 with a double stack first planar array antenna unit with probe fed patches. A dielectric plate 110, bearing on its front face patches 112 is disposed on the front face 114 of the planar antenna assembly 90, having a probe fed first planar antenna array antenna unit. The patches 112 and 91, of the planar antenna assembly 90 (shown in FIG. 16), are substantially aligned with each other.

Figure 18:
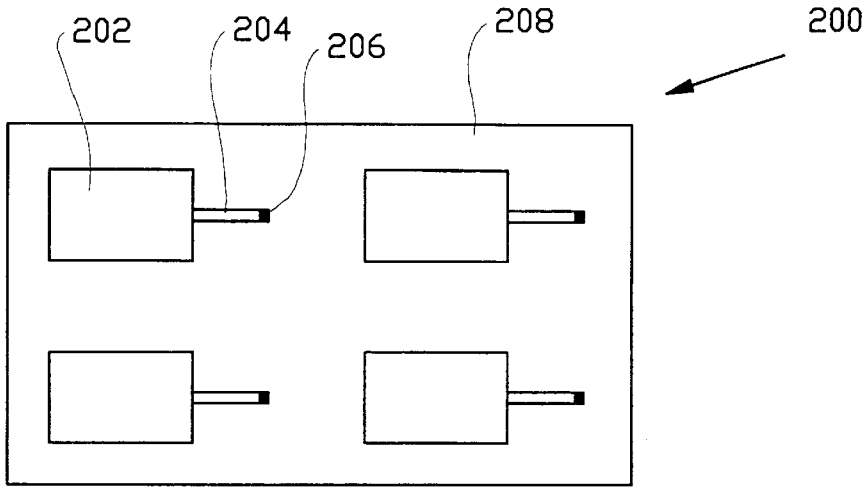
FIG. 18 shows a plan view of a 2×2 subarray of a planar array antenna unit, with electrically (direct) coupled patches, for a plane polarization mode of operation.

The first and second planar array antenna units comprising the planar antenna assembly of the invention can function either in a plane or circular polarization mode of operation. The plan views of the planar array antenna units 20 and 30 shown in FIGS. 5 and 6, respectively, illustrate a plane polarization mode of operation. Since the geometrical feature dictating the polarization mode of operation of the planar array antenna units is the relative orientation of the patches and the feeds, clearly FIGS. 5 and 6 can be replaced by one figure without reference to whether the patch is frequency selective or not and without reference to the frequency band of operation. Furthermore, a 2×2 subarray suffices to demonstrate the circular polarization mode of operation and hence will also be used to demonstrate the plane polarization mode of operation. Attention is drawn to FIG. 18 showing a plan view of a 2×2 subarray of a planar array antenna unit, with electrically (direct) coupled patches, for a plane polarization mode of operation (this is the generic figure for FIGS. 5 and 6). The subarray 200 comprises patches 202, electrically connected to feeds 204, the feeds being equipped with feed line terminals 206. The patches 202 and feeds 204 are disposed on a dielectric plate 208.

Figure 19:
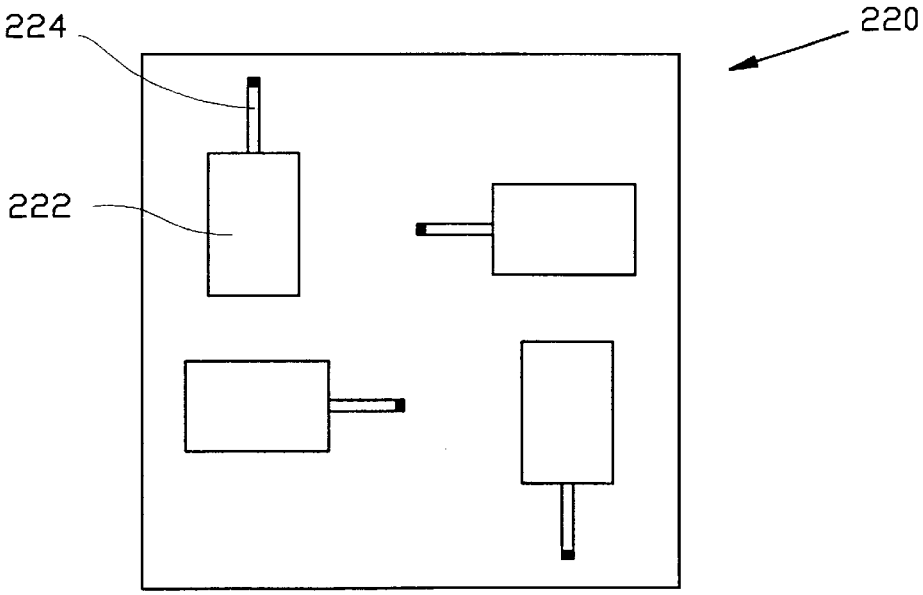
FIG. 19 shows a plan view of a 2×2 subarray of a planar array antenna unit, with electrically (direct) coupled patches, for a circular polarization mode of operation.

Attention is now drawn to FIG. 19 showing a plan view of a 2×2 subarray 220 of a planar array antenna unit, with electrically coupled patches, for a circular polarization mode of operation. As shown, each patch 222 along with its feed 224 is sequentially rotated by 90° in a clockwise sense (or optionally counter-clockwise for replacing right hand by left hand circular polarization). Sequential-rotation of patches and feeds for a circular polarization mode of operation is known per se and is well documented in the literature (see for example J. Huang (1986) and T. Teshirogi (1985)).

Figure 20:
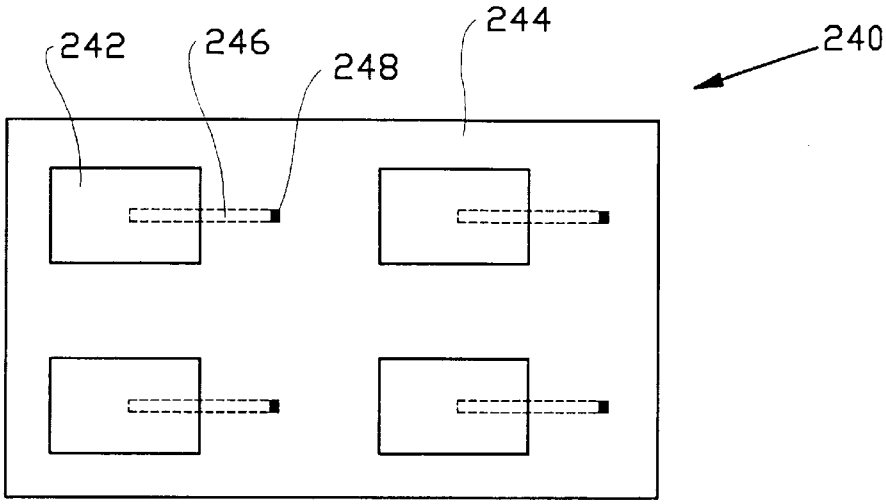
FIG. 20 shows a plan view of a 2×2 subarray of a planar array antenna unit, with electromagnetically coupled patches, for a plane polarization mode of operation.

In the case of an electromagnetically coupled patch, as shown for example in FIG. 12, the patches and feeds are on opposite sides of a dielectric plate but the principle is the same. FIG. 20 shows a plan view of a 2×2 subarray 240 of a planar array antenna unit, with electromagnetically coupled patches, for a plane polarization mode of operation. The patches 242 are disposed on the front face of the dielectric plate 244, whereas the feeds 246 (along with their feed line terminals) are disposed on its rear face. The feeds 246 are drawn with dashed lines to signify that they are not in the same plane as the patches 242.

Figure 21:
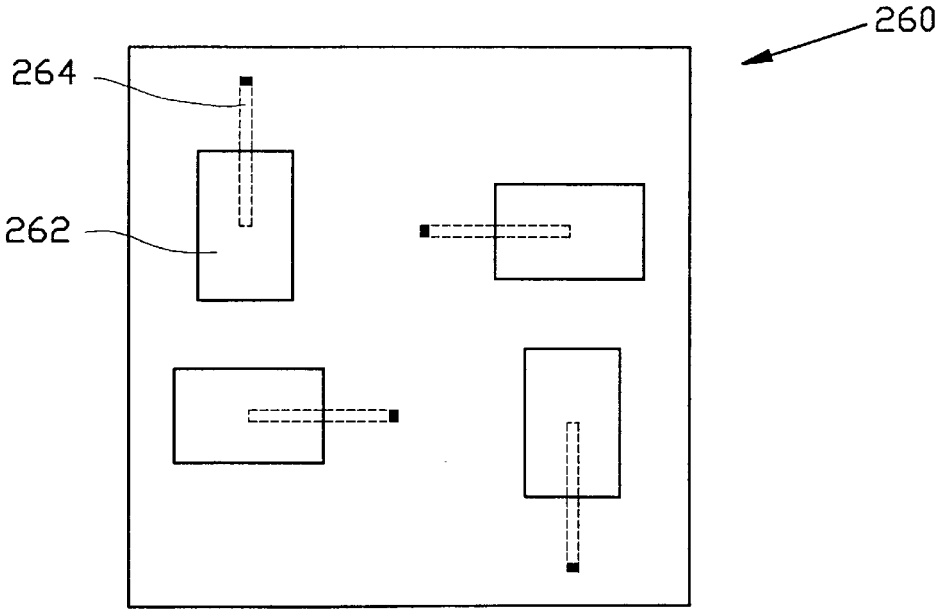
FIG. 21 shows a plan view of a 2×2 subarray of a planar array antenna unit, with electromagnetically coupled patches, for a circular polarization mode of operation.

FIG. 21 shows a plan view of a 2×2 subarray 260 of a planar antenna unit, with electromagnetically coupled patches for a circular polarization mode of operation. Each patch 262 along with its feed 264 is sequentially rotated by 90°.

Figure 22:
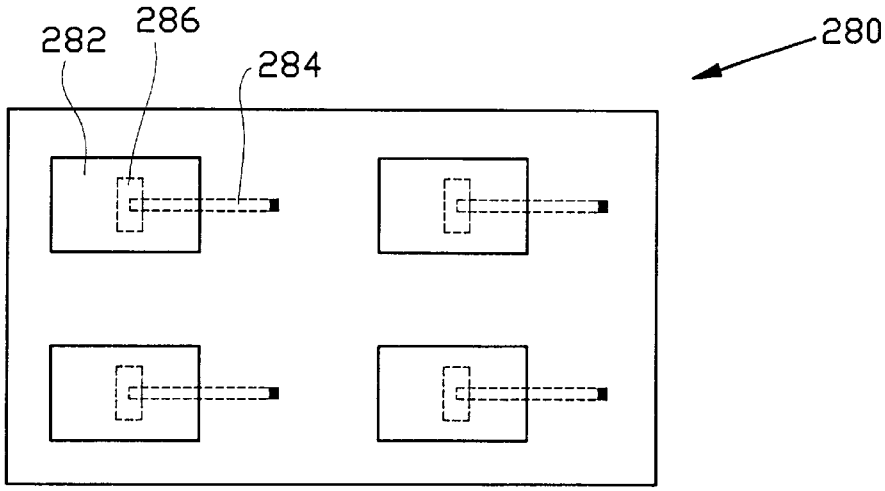
FIG. 22 shows a plan view of a 2×2 subarray of a planar array antenna unit, with aperture-coupled patches, for a plane polarization mode of operation.
Figure 23:
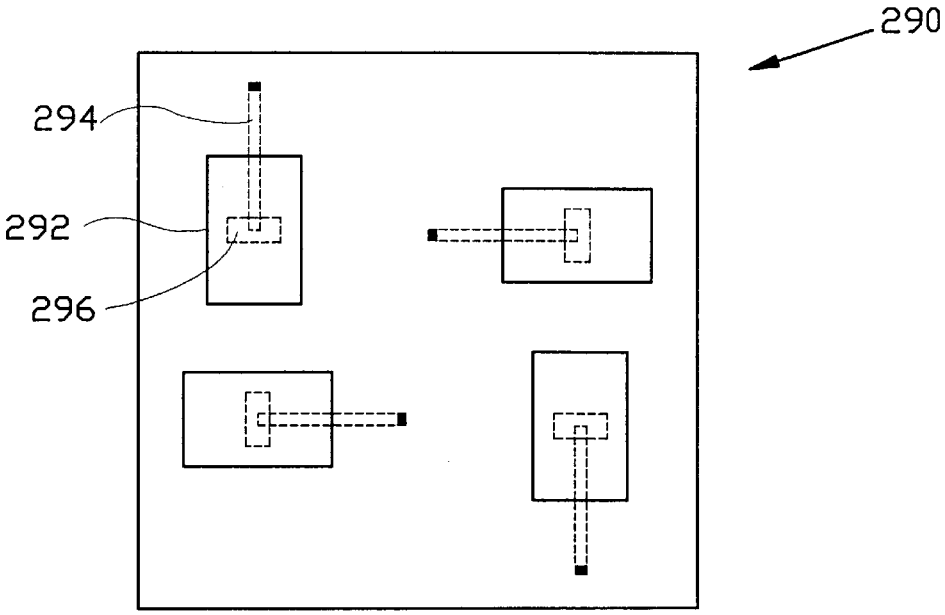
FIG. 23 shows a plan view of a 2×2 subarray of a planar array antenna unit, with aperture-coupled patches, for a circular polarization mode of operation.

Attention is now drawn to FIG. 22 showing a plan view of a 2×2 subarray 280 of a planar array antenna unit, with aperture-coupled patches, for a plane polarization mode of operation. A side view of an antenna unit for an aperture coupled patch is shown in FIG. 14. As can be seen from FIG. 14 there are two dielectric plates involved and the patch, aperture and feed are located in three different planes. In order to illustrate the relative position and orientation of the patch, aperture and feed relative to each other the patches 282 are drawn with solid lines, the feeds 284 are drawn with dashed lines and the apertures 286 are drawn with dotted lines, with the understanding that they are located in three different planes, as indicated in FIG. 14. FIG. 23 shows a plan view of a 2×2 subarray 290 of a planar antenna unit, with aperture coupled patches, for a circular polarization mode of operation. Each patch 292 along with its feed 294 is sequentially rotated by 90°. The apertures 296 do not necessarily undergo sequential rotation.

Figure 24:
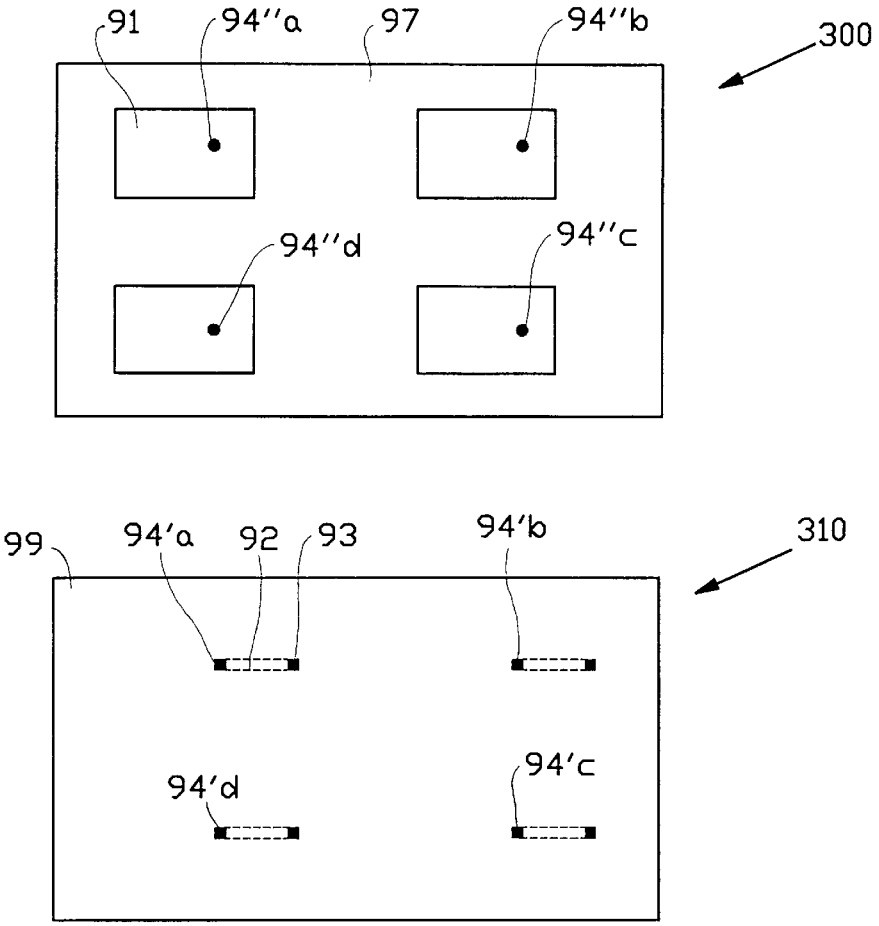
FIG. 24 shows a plan view of a 2×2 subarray of a planar array antenna unit, with probe fed patches, for a plane polarization mode of operation.

Attention is now drawn to FIG. 24 showing a plan view of a 2×2 subarray 300 of the patches 91(*a,b,c,d*) disposed on the dielectric plate 97 of the first planar array antenna unit of planar antenna assembly 90 shown in FIG. 16. Also shown is a plan view of the corresponding 2×2 subarray 310 of the feeds 92(*a,b,c,d*), of the probe fed patches 91(*a,b,c,d*), disposed on the dielectric plate 99. The feeds have been drawn with dashed lines in order to illustrate that they are disposed on the rear face of the dielectric plate 99. The feeds 92(*a,b,c,d*) are connected via feed probes 95 (shown in FIG. 16) to the patches 91(*a,b,c,d*) from the four feed probe terminals 94'(*a,b,c,d*) to the corresponding four patch probe terminals 94"(*a,b,c,d*). FIG. 24 illustrates an arrangement of patches and feeds for a plane polarization mode of operation.

Figure 25:
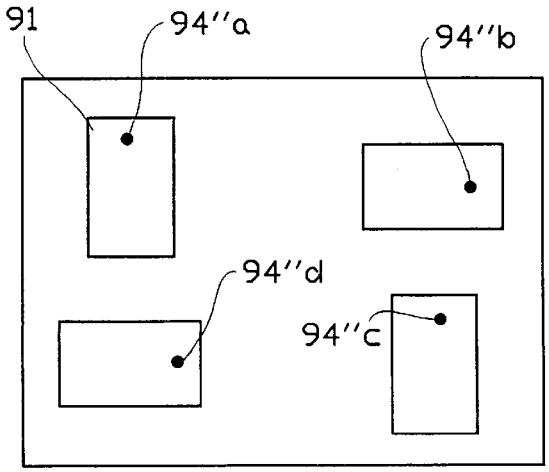
FIG. 25 shows a plan view of a 2×2 subarray of a planar array antenna unit, with probe fed patches, for a circular polarization mode of operation.

Attention is now drawn to FIG. 25 showing a plan view of a 2×2 subarray 300 of the patches 91(*a,b,c,d*) disposed on the dielectric plate 97 of the first planar array antenna unit of planar antenna assembly 90 shown in FIG. 16 for a circular polarization mode of operation. In the subarray 300 the patches 91*a*, 91*b*, 91*c* and 91*d* differ from each other in that each of the patches is rotated, sequentially in a clockwise sense, about an axis perpendicular to its center. This has the effect that the patches 91*a*, 91*b*, 91*c* and 91*d* differ from each other by the location of the patch probe terminals 94"(*a,b,c,d*) of the patches which are sequenced in a clockwise sense such that each of the terminals 94"*a*, 94"*b*, 94"*c* and 94"*d* is angularly displaced by 90° relative to the preceding one in the sequence as reflected in FIG. 24 by the patches' angular orientation with respect to each other including the relative location of each patch probe terminal within the patch. The feed probe terminals are not shown, but there arrangement is similar to that shown in FIG. 24, except that they will be slightly displaced so that each feed probe terminal will be substantially aligned with its corresponding angularly displaced feed patch terminal. For the transmission of circularly polarized electromagnetic radiation phase delays of 90°, 180° and 270° are applied to the currents flowing at feed probe terminals 94'*b,* 94'*c* and 94'*d* relative to terminal 94'*b,* respectively.

What is claimed is:

1. A planar antenna assembly for receiving and transmitting electromagnetic radiation in two frequency bands, said planar antenna assembly comprising, in a layered formation, first and second planar array antenna units, said first planar array antenna unit operating in a low frequency band and said second planar array antenna unit operating in a high frequency band, said first planar array antenna unit being the top planar array antenna unit and said second planar array antenna unit being the bottom planar array antenna unit;

said first planar array antenna unit comprising at least one dielectric plate having front and rear faces, at least one planar array of patches having a plurality of patches, a feed array having a plurality of feeds and a ground plane;

each feed of said feed array being coupled to a respective one of said patches of said at least one planar array of patches;

each patch of said at least one planar array of patches being resonant to frequencies in said low frequency band and transparent to frequencies in said high frequency band;

said ground plane being reflective to frequencies in said low frequency band and transparent to frequencies in said high frequency band;

said second planar array antenna unit comprising at least one dielectric plate having front and rear faces, a ground plane, at least one planar array of patches having a plurality of patches and a feed array having a plurality of feeds, each feed of said feed array being coupled to a respective one of said patches of said at least one planar array of patches.

2. The planar antenna assembly according to claim 1, wherein said first planar array antenna unit comprises a first dielectric plate and a first planar array of patches having a plurality of patches, said first planar array of patches and said feed array being disposed on the front face of said first dielectric plate with each feed of said feed array being electrically coupled to a respective one patch of said patches of said first planar array of patches and said ground plane being disposed on said rear face of said first dielectric plate.

3. The planar antenna assembly according to claim 2, further comprising a second dielectric plate and a second planar array of patches having a plurality of patches, said second planar array of patches being disposed on the front face of said second dielectric plate, said rear face of said second dielectric plate facing the front face of said first dielectric plate and each patch of said first planar array of patches being substantially aligned with a respective one patch of said patches of said second planar array of patches.

4. The planar antenna assembly according to claim 1, wherein said first planar array antenna unit comprises first and second dielectric plates and a first planar array of patches, said first planar array of patches being disposed on the front face of said first dielectric plate and said feed array being disposed on the rear face of said first dielectric plate with each feed of said feed array being electromagnetically coupled to a respective one patch of said patches of said first planar array of patches, said ground plane being disposed on said rear face of said second dielectric plate, and the front face of said second dielectric plate facing the rear face of said first dielectric face.

5. The planar antenna assembly according to claim 1, wherein said first planar array antenna unit comprises first and second dielectric plates and a first planar array of patches having a plurality of patches, said first planar array of patches being disposed on the front face of said first dielectric plate, said ground plane being disposed on the rear face of said first dielectric plate, said ground plane having a plurality of apertures, the front face of said second dielectric plate facing the rear face of said first dielectric face and said feed array being disposed on the rear face of said second dielectric plate with each feed of said feed array being electromagnetically coupled to a respective one of said patches of said first planar array of patches via a respective one of said apertures in said ground plane, said apertures being resonant to frequencies in said low frequency band.

6. The planar antenna assembly according to claim 4, further comprising a third dielectric plate and a second planar array of patches having a plurality of patches, said second planar array of patches being disposed on the front face of said third dielectric plate, said rear face of said third dielectric plate facing the front face of said first dielectric plate and each patch of said second planar array of patches being substantially aligned with a respective one of said patches of said first planar array of patches.

7. The planar antenna assembly according to claim 1, wherein said first planar array antenna unit comprises first and second dielectric plates and a first planar array of patches having a plurality of patches, said planar array of patches being disposed on the front face of said first dielectric plate, said ground plane being disposed on the rear face of said first dielectric plate, said first dielectric plate being spaced from said second dielectric plate so as to form an antenna chamber, said feed array being disposed on the rear face of said second dielectric plate with each feed of said feed array being electrically coupled to a respective one of said patches of said first planar array of patches by a plurality of feed probes and said second planar antenna unit being located within said antenna chamber.

8. The planar antenna assembly according to claim 7, further comprising a third dielectric plate and a second planar array of patches having a plurality of patches, said second planar array of patches being disposed on the front face of said third dielectric plate, said rear face of said third dielectric plate facing the front face of said first dielectric plate and each patch of said second planar array of patches being substantially aligned with a respective one of said patches of said first planar array of patches.

9. The planar antenna assembly according to claim 1, wherein said second planar array antenna unit comprises a first dielectric plate and a first planar array of patches having a plurality of patches, said first planar array of patches and said feed array being disposed on the front face of said first dielectric plate with each feed of said feed array being electrically coupled to a respective one patch of said patches of said first planar array of patches and said ground plane being disposed on said rear face of said first dielectric plate.

10. The planar antenna assembly according to claim 9, further comprising a second dielectric plate and a second planar array of patches having a plurality of patches, said second planar array of patches being disposed on the front face of said second dielectric plate, said rear face of said second dielectric plate facing the front face of said first dielectric plate and each patch of said first planar array of patches being substantially aligned with a respective one patch of said patches of said second planar array of patches.

11. The planar antenna assembly according to claim 1, wherein said second planar array antenna unit comprises first and second dielectric plates and a first planar array of patches, said first planar array of patches being disposed on the front face of said first dielectric plate and said feed array being disposed on the rear face of said first dielectric plate with each feed of said feed array being electromagnetically coupled to a respective one patch of said patches of said first planar array of patches, said ground plane being disposed on said rear face of said second dielectric plate, and the front face of said second dielectric plate facing the rear face of said first dielectric face.

12. The planar antenna assembly according to claim 1, wherein said second planar array antenna unit comprises first and second dielectric plates and a first planar array of patches having a plurality of patches, said first planar array of patches being disposed on the front face of said first dielectric plate, said ground plane being disposed on the rear face of said first dielectric plate, said ground plane having a plurality of apertures, the front face of said second dielectric plate facing the rear face of said first dielectric face and said feed array being disposed on the rear face of said second dielectric plate with each feed of said feed array being electromagnetically coupled to a respective one of said patches of said first planar array of patches via a respective one of said apertures in said ground plane, said apertures being resonant to frequencies in said high frequency band.

13. The planar antenna assembly according to claim 11, further comprising a third dielectric plate and a second planar array of patches having a plurality of patches, said second planar array of patches being disposed on the front face of said third dielectric plate, said rear face of said third dielectric plate facing the front face of said first dielectric plate and each patch of said second planar array of patches being substantially aligned with a respective one of said patches of said first planar array of patches.

14. The planar antenna assembly according to any one of claims 2 to 6, wherein said second planar antenna unit is in accordance with claim 9 and said first and second planar antenna units are separated by a dielectric plate with front and rear faces, said front and rear faces of said dielectric plate facing said first and second planar antenna units respectively.

15. The planar antenna assembly according to any one of claims 2 to 6, wherein said second planar antenna unit is in accordance with claim 10 and said first and second planar antenna units are separated by a dielectric plate with front and rear faces, said front and rear faces of said dielectric plate facing said first and second planar antenna units respectively.

16. The planar antenna assembly according to any one of claims 2 to 6, wherein said second planar antenna unit is in accordance with claim 11 and said first and second planar antenna units are separated by a dielectric plate with front and rear faces, said front and rear faces of said dielectric plate facing said first and second planar antenna units respectively.

17. The planar antenna assembly according to any one of claims 2 to 6, wherein said second planar antenna unit is in accordance with claim 12 and said first and second planar antenna units are separated by a dielectric plate with front and rear faces, said front and rear faces of said dielectric plate facing said first and second planar antenna units respectively.

18. The planar antenna assembly according to any one of claims 2 to 6, wherein said second planar antenna unit is in accordance with claim 13 and said first and second planar antenna units are separated by a dielectric plate with front and rear faces, said front and rear faces of said dielectric plate facing said first and second planar antenna units respectively.

19. The planar antenna assembly according to either of claims 7 or 8, wherein said second planar antenna unit is in accordance with claim 9 and is located within said antenna chamber, with a dielectric plate interposed between said second antenna unit and said ground plane of said first antenna unit.

20. The planar antenna assembly according to either of claims 7 or 8, wherein said second planar antenna unit is in accordance with claim 10 and is located within said antenna chamber, with a dielectric plate interposed between said second antenna unit and said ground plane of said first antenna unit.

21. The planar antenna assembly according to either of claims 7 or 8, wherein said second planar antenna unit is in accordance with claim 11 and is located within said antenna chamber, with a dielectric plate interposed between said second antenna unit and said ground plane of said first antenna unit.

22. The planar antenna assembly according to either of claims 7 or 8, wherein said second planar antenna unit is in accordance with claim 12 and is located within said antenna chamber, with a dielectric plate interposed between said second antenna unit and said ground plane of said first antenna unit.

23. The planar antenna assembly according to either of claims 7 or 8, wherein said second planar antenna unit is in accordance with claim 13 and is located within said antenna chamber, with a dielectric plate interposed between said second antenna unit and said ground plane of said first antenna unit.

24. A planar antenna assembly according to claim 1, wherein said first planar array antenna unit is designed for the reception and transmission of circularly polarized electromagnetic radiation and is characterized in that:

said at least one array of patches of said first planar array antenna unit is grouped into 2×2 patch subarrays having each in clockwise or counter-clockwise sequence first, second, third and fourth subarray members; said feeds of said feed array of said first planar array antenna unit are grouped into 2×2 feed subarrays having each in clockwise or counter-clockwise sequence first, second, third and fourth subarray members; each member of a given feed subarray being coordinated with one member of a given patch subarray, the feeds and patches in a given coordinated subarray being rotated by 90° with respect to a sequentially preceding subarray member.

25. A planar antenna assembly according to claim 1, wherein said second planar array antenna unit is designed for the reception and transmission of circularly polarized electromagnetic radiation and is characterized in that:

said at least one array of patches of said second planar array antenna unit is grouped into 2×2 patch subarrays having each in clockwise or counter-clockwise sequence first, second, third and fourth subarray members; said feeds of said feed array of said second planar array antenna unit are grouped into 2×2 feed subarrays having each in clockwise or counterclockwise sequence first, second, third and fourth subarray members; each member of a given feed subarray being coordinated with one member of a given patch subarray, the feeds and patches in a given coordinated subarray being rotated by 90° with respect to a sequentially preceding subarray member.

26. A planar antenna assembly according to claim 1, wherein said low frequency band at which the first antenna unit operates is the L-band and said high frequency band at which the second antenna unit operates is the $K_u$-band.

27. A planar antenna assembly according to claim 1, also comprising a radome.

28. A planar antenna assembly in accordance with claim 24 wherein said second planar array antenna unit is designed for the reception and transmission of circularly polarized electromagnetic radiation and is characterized in that:

said at least one array of patches of said second planar array antenna unit is grouped into 2×2 patch subarrays having each in clockwise or counterclockwise sequence first, second, third and fourth subarray members; said feeds of said feed array of said second planar array antenna unit are grouped into 2×2 feed subarrays having each in clockwise or counter-clockwise sequence first, second, third and fourth subarray members; each member of a given feed subarray being coordinated with one member of a given patch subarray, the feeds and patches in a given coordinated subarray being rotated by 90° with respect to a sequentially preceding subarray member.

* * * * *